US011273098B2

(12) United States Patent
Nichols

(10) Patent No.: US 11,273,098 B2
(45) Date of Patent: Mar. 15, 2022

(54) BARBELL MASSAGE ROLLER AND METHOD OF USING SAME

(71) Applicant: James Christopher Nichols, Lilburn, GA (US)

(72) Inventor: James Christopher Nichols, Lilburn, GA (US)

( * ) Notice: Subject to any disclaimer, the term of this patent is extended or adjusted under 35 U.S.C. 154(b) by 286 days.

(21) Appl. No.: 16/681,819

(22) Filed: Nov. 13, 2019

(65) Prior Publication Data

US 2020/0146928 A1 May 14, 2020

Related U.S. Application Data

(60) Provisional application No. 62/758,665, filed on Nov. 11, 2018.

(51) Int. Cl.

| | |
|---|---|
| ***A61H 15/00*** | (2006.01) |
| ***A63B 21/072*** | (2006.01) |
| ***A63B 21/078*** | (2006.01) |

(52) U.S. Cl.

CPC ..... *A61H 15/0092* (2013.01); *A63B 21/078* (2013.01); *A63B 21/0724* (2013.01); (Continued)

(58) Field of Classification Search

CPC ..... A61H 15/0092; A61H 2015/0014; A61H 2201/1261; A61H 2201/1692; (Continued)

(56) References Cited

U.S. PATENT DOCUMENTS 2,369,544 A 2/1945 Dolan
3,672,358 A * 6/1972 Majewski ..... A61H 15/0092 601/132

(Continued)

FOREIGN PATENT DOCUMENTS

CN 206063396 U 4/2017
DE 3039026 A1 5/1982

(Continued)

OTHER PUBLICATIONS

COG—The World's First Barbell Foam Roller (Canceled) by Lamark, posted at kickstarter.com, posting date Nov. 16, 2017, © Kickstarter, [online], [site visited Feb. 10, 2020]. Available from Internet, <URL: https://www.kickstarter.com/projects/lamarkcog/cog-the-worlds-first-barbell-foam-roller>.

*Primary Examiner* — Garrett K Atkinson
(74) *Attorney, Agent, or Firm* — Inventech Patent Services, LLC; Marc A. Scharich

(57) ABSTRACT

A barbell massage roller includes a roller core having a roller core cavity defined therein. A longitudinal center axis of the barbell massage roller extends through a center of the roller core cavity. The barbell massage roller further includes a roller body having a roller body cavity defined therein. The roller body is disposed on the roller core. The roller body further includes a plurality of helical clusters, each including a plurality of helical protrusions. Each of the plurality of helical protrusions define at least one curved massage surface area. At least the roller core cavity is shaped and sized such that the barbell massage roller is capable of being installed onto a sleeve of a barbell, thereby permitting a user to administer self-massage when the barbell massage roller is installed onto the sleeve of the barbell. At least one method of using a barbell massage roller is disclosed.

17 Claims, 19 Drawing Sheets

(52) U.S. Cl.
CPC ..... *A61H 2015/0014* (2013.01); *A61H 2201/1261* (2013.01); *A61H 2201/1692* (2013.01)

(58) Field of Classification Search
CPC ..... A61H 2201/0119; A61H 2205/062; A61H 2205/081; A61H 2205/088; A61H 7/007; A61H 15/00; A61H 2205/108; A63B 21/0724; A63B 21/078
See application file for complete search history.

(56) References Cited

U.S. PATENT DOCUMENTS

| | | | | |
|---|---|---|---|---|
| D243,557 | S | 3/1977 | Kientz | |
| 4,029,312 | A * | 6/1977 | Wright | A63B 21/0602 482/108 |
| D253,373 | S | 11/1979 | Celeste | |
| 5,346,449 | A * | 9/1994 | Schlagel | A63B 21/0728 482/107 |
| D514,264 | S * | 1/2006 | Viola | D1/126 |
| D527,831 | S | 9/2006 | Hong | |
| 7,189,210 | B1 | 3/2007 | Hillman | |
| 7,559,886 | B2 * | 7/2009 | Knyrim | A61H 19/44 600/38 |
| D624,711 | S * | 9/2010 | Shatoff | D30/160 |
| 8,142,376 | B2 * | 3/2012 | Gueret | A61H 15/02 601/122 |
| D721,183 | S * | 1/2015 | Mallory | D24/211 |
| 9,005,146 | B2 | 4/2015 | Phillips | |
| D734,480 | S * | 7/2015 | Jones | D24/211 |
| D751,724 | S | 3/2016 | Nelson | |
| D765,871 | S | 9/2016 | Downare | |
| 9,463,133 | B2 | 10/2016 | Rodgers | |
| D796,053 | S | 8/2017 | Phillips | |
| D800,330 | S * | 10/2017 | Loos | A61H 15/00 D24/211 |
| D829,920 | S | 10/2018 | Carpinelli | |
| 10,213,638 | B2 | 2/2019 | Black | |
| D843,592 | S * | 3/2019 | Tsuyama | D24/215 |
| 10,426,992 | B2 | 10/2019 | Sardinas | |
| 2004/0249322 | A1 * | 12/2004 | Cohen | A61H 7/001 601/131 |
| 2007/0179336 | A1 * | 8/2007 | Knyrim | A61H 21/00 600/38 |
| 2008/0255484 | A1 * | 10/2008 | Gueret | A61H 15/02 601/129 |
| 2010/0049106 | A1 * | 2/2010 | Gueret | A45D 34/041 601/112 |
| 2011/0257569 | A1 * | 10/2011 | Robins | A61H 15/00 601/137 |
| 2012/0135844 | A1 * | 5/2012 | Huang | A63B 21/4035 482/108 |
| 2016/0074274 | A1 * | 3/2016 | Mallory | A61H 15/0092 601/119 |
| 2016/0279009 | A1 * | 9/2016 | Somjee | A61H 1/008 |
| 2017/0042756 | A1 * | 2/2017 | Nelson | A61H 15/00 |
| 2017/0105895 | A1 | 4/2017 | Sardinas | |
| 2018/0042807 | A1 * | 2/2018 | Mallory | A61H 15/0092 |
| 2018/0326254 | A1 * | 11/2018 | Earls | A63B 26/003 |
| 2018/0353371 | A1 | 12/2018 | Shikahama | |
| 2019/0060160 | A1 | 2/2019 | Krichevsky et al. | |

FOREIGN PATENT DOCUMENTS

| | | | |
|---|---|---|---|
| EP | 1982684 | A2 | 10/2008 |
| GB | 295706 | A | 7/1929 |
| NO | 314338 | B1 | 3/2003 |
| WO | 2018008797 | A1 | 1/2018 |
| WO | 2018058179 | A1 | 4/2018 |

* cited by examiner

BARBELL MASSAGE ROLLER AND METHOD OF USING SAME

CROSS-REFERENCE TO RELATED APPLICATIONS

This application claims the benefit of priority to U.S. Provisional Patent Application Ser. No. 62/758,665, entitled "Barbell Massage Roller" and filed Nov. 11, 2018, the disclosure of which is hereby incorporated by reference in its entirety for all purposes.

TECHNICAL FIELD

The present disclosure relates generally to massage devices and, more particularly, to a barbell massage roller and at least one method of using a barbell massage roller.

BACKGROUND

Massage therapy typically involves the manual manipulation of the soft tissues of the human body, such as muscles, tendons, ligaments and connective tissue. Massage therapy has long been employed as a way to relieve ailments of the human body related to tight, overstimulated or otherwise strained muscles. Furthermore, massage therapy has long been employed as a way to reduce pain, stress and to rehabilitate various injuries. Excess neural tone or residual muscular tension can exist as an after-effect of exercise, stress or muscle disuse when muscles are kept in a shortened state (e.g., prolonged sitting). The kneading of muscles and other soft tissues has proven to be directly beneficial to the musculoskeletal and nervous systems by way of relieving excess neural tone in the muscles and connective tissues. Furthermore, the kneading of muscles and other soft tissues has also proven to be beneficial toward the circulatory and lymphatic systems by way of increasing substance exchange between the cells and by increasing blood circulation.

Massage therapists, sometimes called masseurs, often treat clients by way of various techniques of manual manipulation of the muscles and soft tissues of the human body. In this regard, masseurs typically use their hands, forearms, fingers and elbows to knead the muscles and soft tissues. For example, myofascial release is a technique often practiced by masseurs which employs sustained pressure in order to release painful trigger points, which are localized areas of clenched or overstimulated muscle fibers. The myofascial release technique is also simple enough that it may be self-administered.

The administering of self-massage (e.g., without the employment of a masseur) through the use of manually employable mechanical massage devices has provided users an avenue toward self-treatment of the aforementioned ailments of the human body. Such mechanical massage devices typically provide a way by which the user can apply mechanical pressure to their body to knead the muscles and soft tissue, or to use directed pressure to release trigger points. This allows users to self-administer various massage techniques such as effleurage (longitudinal gliding), kneading, trigger point therapy, myofascial release and cross-fiber friction techniques. Many of these mechanical massage devices often utilize rolling elements, typically in the form of rollers, which are intended to roll about their axis in order to deliver mechanical pressure by direct physical contact with external surfaces of the human body. These devices, generally known as massage roller devices, have become ubiquitous in the field of physical therapy and have also gained popularity in the sports and fitness industry because of their ability to physically relax individuals, as well as counteract or relieve body pains.

Massage roller devices typically fall into one of three categories. The first category of massage roller devices typically relates to stick massage rollers. Stick massage rollers are often relatively smaller, as compared to other known massage roller devices, and are typically made up of one or more rollers which are rotatably mounted to a central axle, much like a conventional rolling pin. Typically, the central axle is fitted with one or more handles at each opposing end outside of the one or more rollers. During use, the user typically holds the one or more handles and moves the one or more rollers over some surface of their body in a rolling pin like motion. The second category of massage roller devices typically relates to foam rollers, often simply referred to as massage rollers. Foam rollers/massage rollers are typically made up of a cylindrically-shaped roller body which is relatively larger in diameter than most stick massage rollers, and have no central handle or handles like a stick massage roller. Foam rollers/massage rollers are typically intended to roll about their axial plane over a flat surface. In this regard, during use, foam rollers/massage rollers are typically positioned to be sandwiched between the user and a wall or a fixed support surface such as the floor, thus allowing the user to move some surface of their body over the outer surface of the foam roller/massage roller by way of lateral motion of their body. The third category of massage roller devices typically relates to massage balls. Massage balls often come in various sizes and are typically spherically-shaped. Similar to foam rollers/massage rollers, massage balls typically also rely on the use of a fixed support surface such as the floor, whereby during use the user may sandwich the massage ball between a wall or the fixed support surface and some surface of their body, and then proceed to move the surface of their body over the massage ball.

Various challenges and limitations exist, however, with regard to using known versions of such aforementioned massage roller devices, particularly relating to their overall lack of versatility.

Stick massage rollers rely on the user's hands and arms in order to stabilize and apply pressure to the body. Stick massage rollers are held in the user's hands, as previously discussed, enabling the user to direct and manually roll the stick massage roller over the affected area of the body while the muscles in that area remain relaxed. Deep tissue massage is better performed on muscles when they are in a passive or relaxed state. However, due to the need for stick massage rollers to be held with the user's hands, a user has limited access to certain areas of their body when attempting self-massage (e.g. the user's back, under the user's arms, the user's arms themselves or the user's shoulders). Furthermore, the user is limited in that any pressure applied to the surface of the user's body is applied by the user's own muscles, thus not fully enabling the user to relax during self-massage. This therefore tends to limit stick massage rollers to be most effective for massaging the smaller muscles and connective tissues of the limbs.

Foam rollers/massage rollers tend to be limited in that they are primarily intended to be used against a fixed support surface such as a floor or a wall, as previously discussed. These foam rollers/massage rollers rely on directed force applied by the user against the fixed support surface, or on the user's body weight, when used in conjunction with the fixed support surface to perform massage techniques, such as continuous rolling methods. The foam roller/massage roller has the mechanical advantage of pressure which is applied by the body weight of the user, as well as being well-suited to reach a user's back. Its method of use, however, allows it limited access to certain portions of the human body, such as the inner thigh or tops of the shoulders. Additionally, most versions of this kind of massage roller have planar surfaces which are either flat or covered with nodules (e.g., some of which are shaped/contoured too sharply or aggressively and may cause some users unnecessary discomfort when pressure is applied to their body). As such, this tends to limit their ability to perform pinpoint massage methods as well as limiting their ability to reach smaller inner contours of the human body. Furthermore, under most circumstances, foam rollers/massage rollers often require the user to support their own body weight during use. Deep tissue massage is better performed on muscles when they are in a passive/relaxed state, as previously discussed. As such, if the user's muscles are being used to resist the effects of gravity, these muscles are in an active state which makes it difficult for the user to relax targeted muscles when the user is physically rolling atop a foam roller/massage roller.

Since massage balls are typically spherically-shaped, as previously discussed, they often lack the relatively larger lateral surface area that some of the aforementioned kinds of massage roller devices typically provide. While their spherical shape makes them particularly useful for reaching smaller contours of the human body, such as the bottom of the foot, massage balls are inherently less stable than other kinds of massage roller devices because of their spherical shape. As such, massage balls tend to be limited and more well-suited for pinpoint massage methods such as trigger point therapy and deep tissue massage. Their spherical shape, however, makes them more difficult to use for long continuous rolling massage methods, i.e. effleurage (longitudinal gliding massage), in comparison to other kinds of massage roller devices, such as foam rollers/massage rollers.

With at least the aforementioned challenges and limitations in mind, there is a continuing unaddressed need for a massage roller device which is capable of providing the user with more effective ways in which to administer self-massage. Such a massage roller device should be capable of being particularly effective in relieving pain and discomfort associated with tight muscles, trigger points or other connective tissue or soft tissue ailments. Additionally, there is a continuing unaddressed need for a massage roller device which is more versatile than other massage roller devices, and is thus capable of providing the user with the benefits of the directed manual application on relaxed muscles that a stick massage roller typically provides, the mechanical advantage and use of continuous rolling methods that a foam roller/massage roller typically provides, as well as the pinpoint massage methods and advantages of a smaller surface area that a massage ball typically provides.

SUMMARY

At least the above-identified needs are addressed with the present disclosure. One aspect of the present disclosure is directed to a barbell massage roller. The barbell massage roller includes a generally elongated, cylindrical roller core having a first end and a second end disposed opposite the first end. The roller core further has a hollow roller core cavity defined therein and extending through the roller core between the first and second ends of the roller core. The roller core cavity defines an interior surface of the roller core. The roller core further has an exterior surface opposing the interior surface of the roller core. A longitudinal center axis of the barbell massage roller extends through at least the first and second ends of the roller core and through a center of the roller core cavity of the roller core. Additionally, the barbell massage roller further includes a generally elongated roller body having a first end and a second end disposed opposite the first end of the roller body. The roller body further has a hollow roller body cavity defined therein and extending between the first and second ends of the roller body. The roller body cavity defines an interior surface of the roller body. The roller body is disposed on the roller core such that the roller core is disposed at least partially within the roller body cavity of the roller body. The roller body further includes a plurality of helical clusters disposed along the longitudinal center axis of the barbell massage roller. The plurality of helical clusters includes a first helical cluster. The first helical cluster includes a plurality of helical protrusions disposed annularly about the roller body, each of the plurality of helical protrusions being generally elongated and projecting at least radially outwardly from the roller body, each of the plurality of helical protrusions defining at least one curved massage surface area, each of the plurality of helical protrusions further being twisted about the longitudinal center axis of the barbell massage roller, in a first rotational direction, in a helical manner. The plurality of helical clusters further includes a second helical cluster disposed immediately adjacent to the first helical cluster. The second helical cluster includes a plurality of helical protrusions disposed annularly about the roller body, each of the plurality of helical protrusions of the second helical cluster being generally elongated and projecting at least radially outwardly from the roller body, each of the plurality of helical protrusions of the second helical cluster defining at least one curved massage surface area, each of the plurality of helical protrusions of the second helical cluster further being twisted about the longitudinal center axis of the barbell massage roller, in a second rotational direction which is opposite the first rotational direction, in a helical manner. Furthermore, at least the roller core cavity of the roller core is shaped and sized such that the barbell massage roller is capable of being installed onto a sleeve of a barbell, thereby permitting a user to administer self-massage when the barbell massage roller is installed onto the sleeve of the barbell.

Another aspect of the present disclosure is directed to a barbell massage roller. The barbell massage roller includes a generally elongated, cylindrical, rigid roller core having a first end and a second end disposed opposite the first end. The roller core further has a hollow roller core cavity defined therein and extending through the roller core between the first and second ends of the roller core. The roller core cavity defines an interior surface of the roller core. The roller core further has an exterior surface opposing the interior surface of the roller core. A longitudinal center axis of the barbell massage roller extends through at least the first and second ends of the roller core and through a center of the roller core cavity of the roller core. Additionally, the barbell massage roller further includes a generally elongated, resilient roller body having a first end and a second end disposed opposite the first end of the roller body. The roller body further has a hollow roller body cavity defined therein and extending between the first and second ends of the roller body. The roller body cavity defines an interior surface of the roller body. The roller body is disposed on the roller core such that the roller core is disposed at least partially within the roller body cavity of the roller body. The roller body further includes a plurality of helical clusters disposed along the longitudinal center axis of the barbell massage roller. The plurality of helical clusters includes a first helical cluster. The first helical cluster includes a plurality of helical protrusions disposed annularly about the roller body, each of the plurality of helical protrusions being generally elongated and projecting at least radially outwardly from the roller body, each of the plurality of helical protrusions defining at least one curved massage surface area, each of the plurality of helical protrusions further being twisted about the longitudinal center axis of the barbell massage roller, in a first rotational direction, in a helical manner. The plurality of helical clusters further includes a second helical cluster disposed immediately adjacent to the first helical cluster. The second helical cluster includes a plurality of helical protrusions disposed annularly about the roller body, each of the plurality of helical protrusions of the second helical cluster being generally elongated and projecting at least radially outwardly from the roller body, each of the plurality of helical protrusions of the second helical cluster defining at least one curved massage surface area, each of the plurality of helical protrusions of the second helical cluster further being twisted about the longitudinal center axis of the barbell massage roller, in a second rotational direction which is opposite the first rotational direction, in a helical manner. The plurality of helical clusters further includes a third helical cluster disposed immediately adjacent to the second helical cluster. The third helical cluster includes a plurality of helical protrusions disposed annularly about the roller body, each of the plurality of helical protrusions of the third helical cluster being generally elongated and projecting at least radially outwardly from the roller body, each of the plurality of helical protrusions of the third helical cluster defining at least one curved massage surface area, each of the plurality of helical protrusions of the third helical cluster further being twisted about the longitudinal center axis of the barbell massage roller, in the first rotational direction which is opposite the second rotational direction, in a helical manner. The plurality of helical clusters further includes a fourth helical cluster disposed immediately adjacent to the third helical cluster. The fourth helical cluster includes a plurality of helical protrusions disposed annularly about the roller body, each of the plurality of helical protrusions of the fourth helical cluster being generally elongated and projecting at least radially outwardly from the roller body, each of the plurality of helical protrusions of the fourth helical cluster defining at least one curved massage surface area, each of the plurality of helical protrusions of the fourth helical cluster further being twisted about the longitudinal center axis of the barbell massage roller, in the second rotational direction which is opposite the first rotational direction, in a helical manner. Furthermore, at least the roller core cavity of the roller core is shaped and sized such that the barbell massage roller is capable of being installed onto a sleeve of a standard Olympic barbell, thereby permitting a user to administer self-massage when the barbell massage roller is installed onto the sleeve of the standard Olympic barbell.

Yet another aspect of the present disclosure is directed to a method of using a barbell massage roller. The method of using a barbell massage roller includes providing a barbell massage roller. The barbell massage roller includes a generally elongated, cylindrical roller core, the roller core having a hollow roller core cavity defined therein. The barbell massage roller further includes a generally elongated roller body, the roller body having a hollow roller body cavity defined therein, the roller body being disposed on the roller core such that the roller core is disposed at least partially within the roller body cavity of the roller body. At least the roller core cavity of the roller core is shaped and sized such that the barbell massage roller is capable of being installed onto a sleeve of a standard Olympic barbell.

BRIEF DESCRIPTION OF THE DRAWINGS

One or more exemplary embodiments of the present disclosure are pointed out with particularity in the appended claims. However, other features of the one or more embodiments will become more apparent and will be best understood by referring to the following detailed description in conjunction with the accompanying drawings, wherein:

DETAILED DESCRIPTION

As required, one or more detailed embodiments of the present disclosure are disclosed herein, however, it is to be understood that the disclosed embodiments are merely exemplary of the disclosure that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure. Furthermore, the use of a singular term, such as, "a" is not to be interpreted as limiting the number of components or details of particular components.

Additionally, various terms and/or phrases describing or indicating a position or directional reference such as, but not limited to, "top", "bottom", "front", "rear", "forward", "rearward", "end", "outer", "inner", "left", "right", "vertical", "horizontal", etc. may relate to one or more particular components as seen generally from a user's vantage point during use or operation, and such terms and/or phrases are not to be interpreted as limiting, but merely as a representative basis for describing the disclosure to one skilled in the art.

Figure 1:
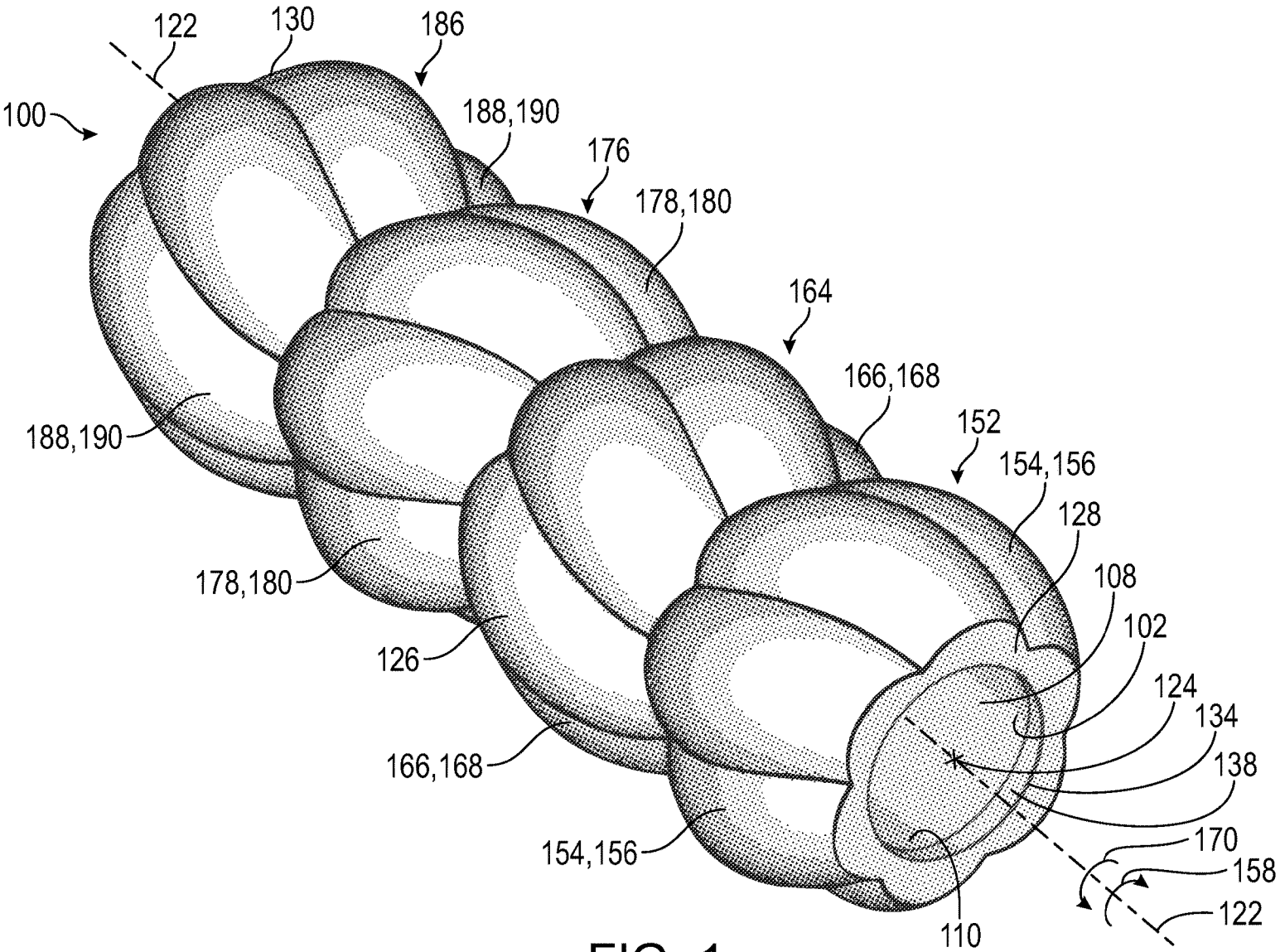
FIG. 1 is a perspective view of a barbell massage roller according to one exemplary embodiment of the present disclosure.
Figure 2:
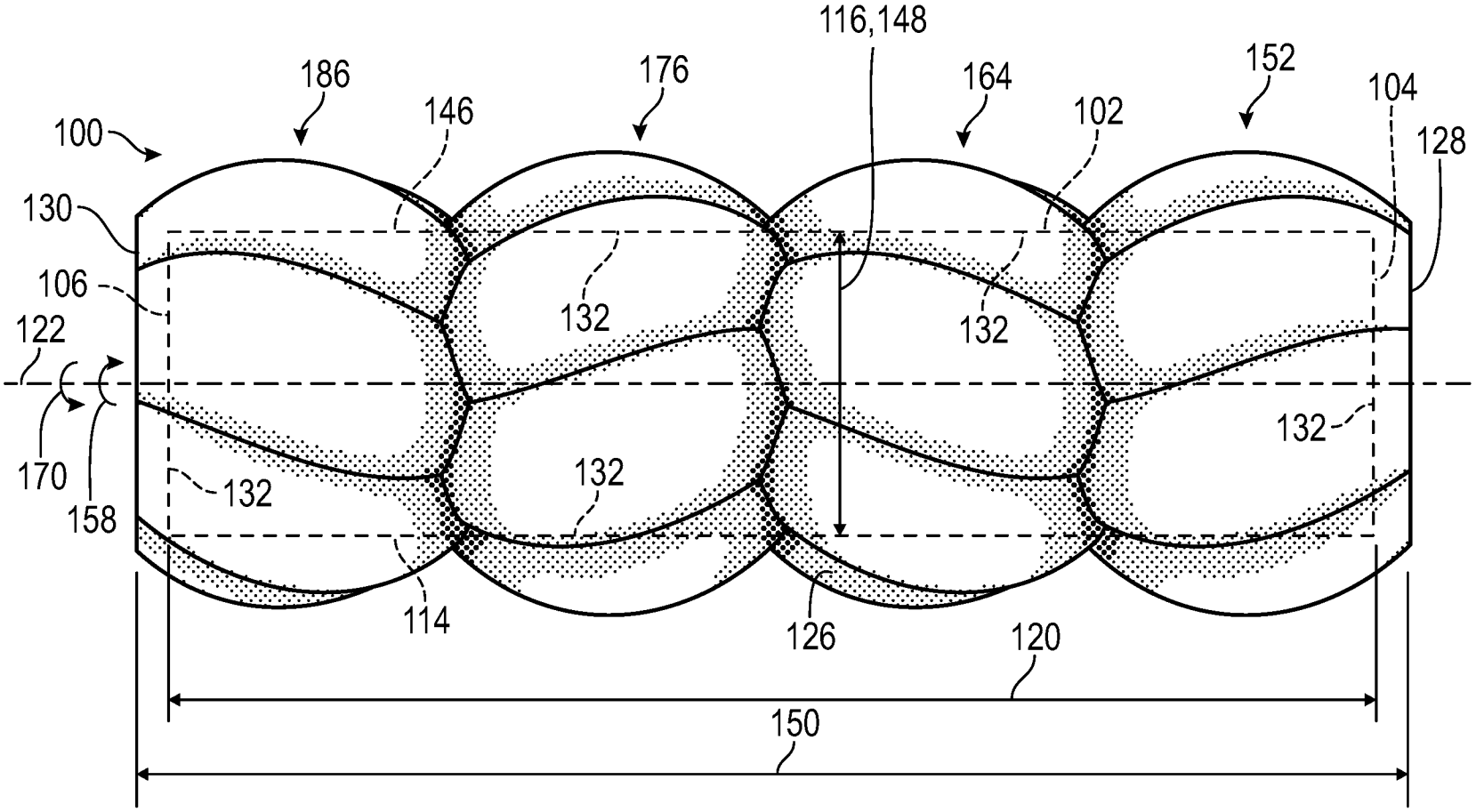
FIG. 2 is a front elevational view of the barbell massage roller shown in FIG. 1.
Figure 3:
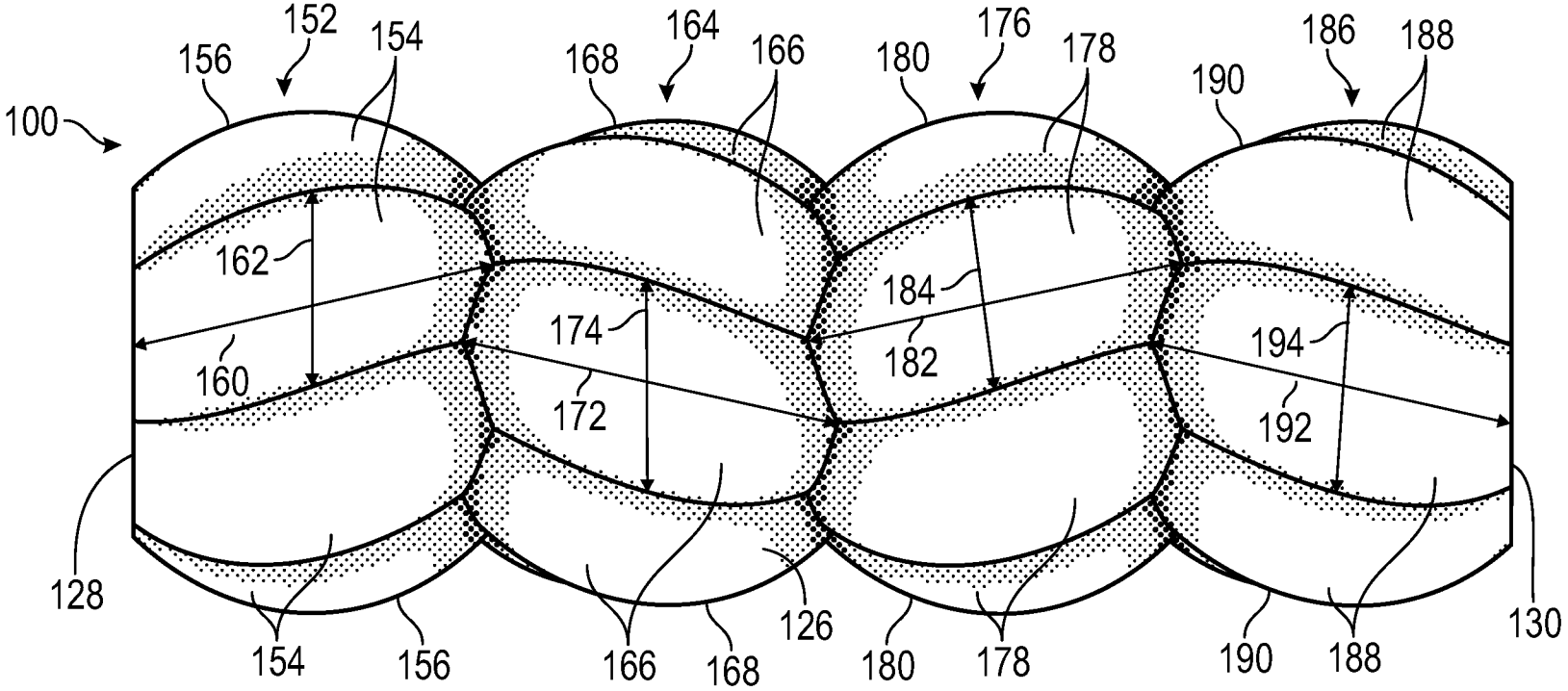
FIG. 3 is a rear elevational view of the barbell massage roller shown in FIGS. 1 and 2.
Figure 4:
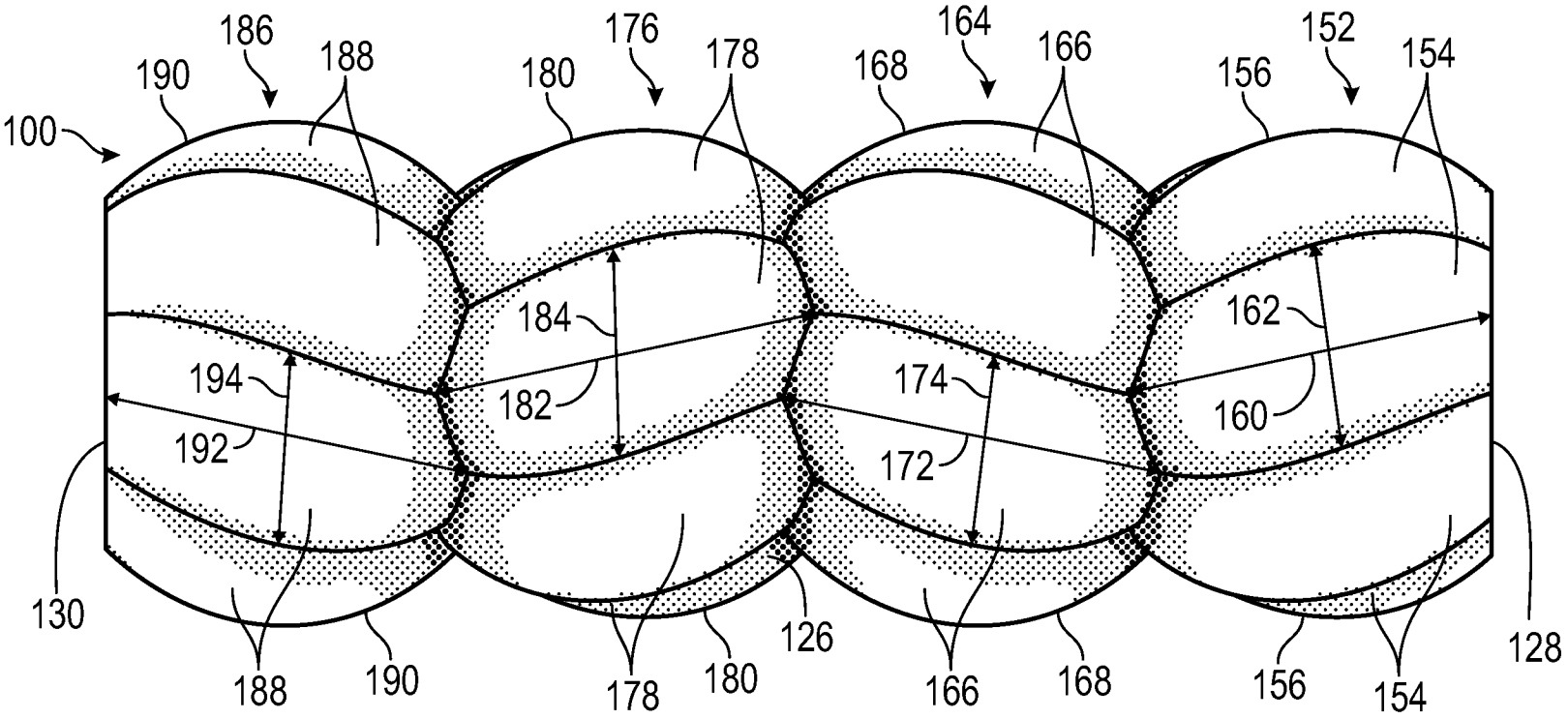
FIG. 4 is a top plan view of the barbell massage roller shown in FIGS. 1-3.
Figure 5:
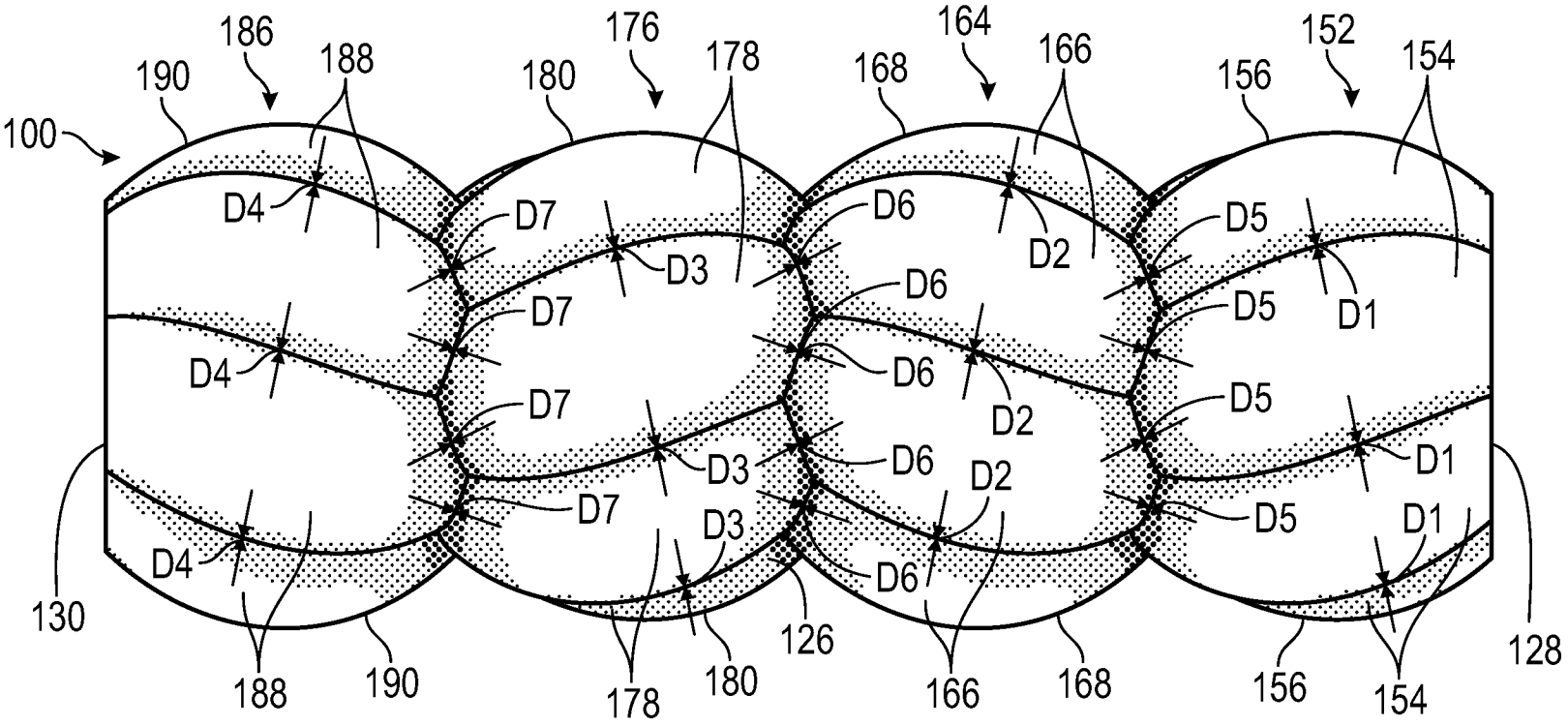
FIG. 5 is a bottom plan view of the barbell massage roller shown in FIGS. 1-4.
Figure 6:
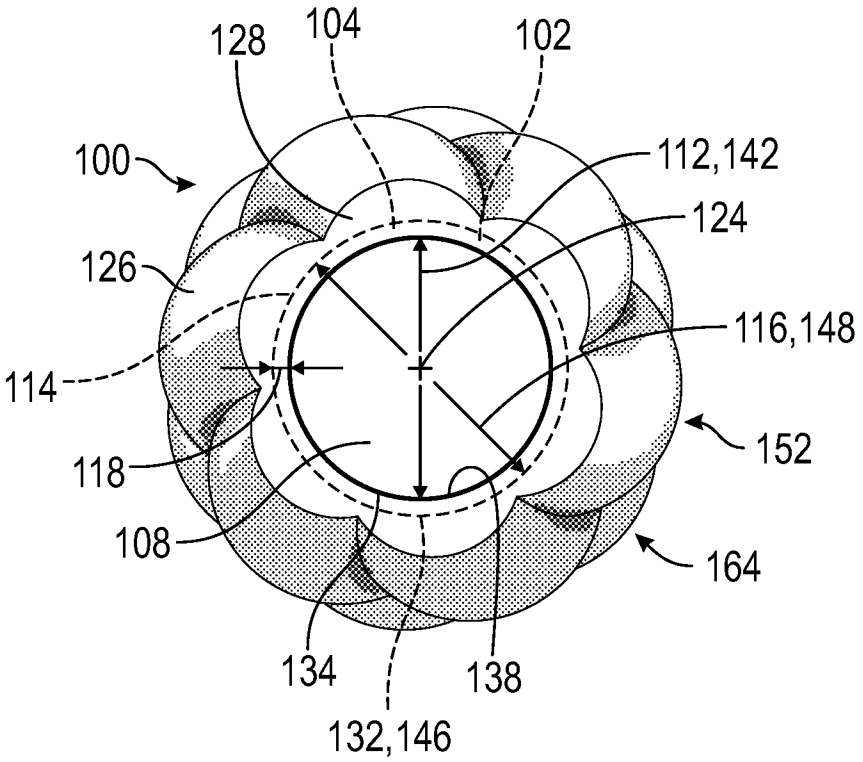
FIG. 6 is a first-end elevational view of the barbell massage roller shown in FIGS. 1-5.
Figure 7:
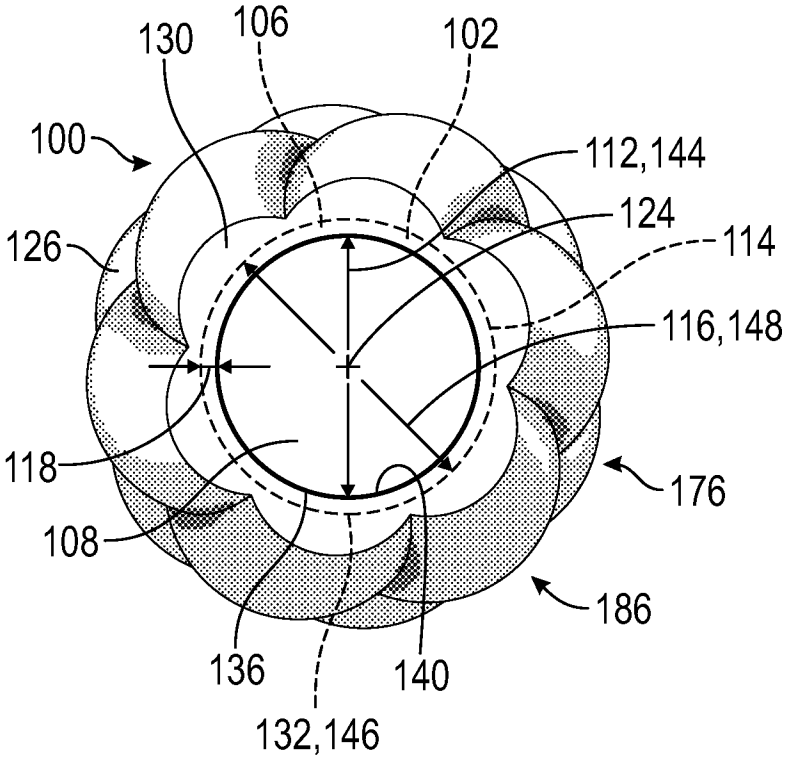
FIG. 7 is a second-end elevational view of the barbell massage roller shown in FIGS. 1-6.
Figure 8:
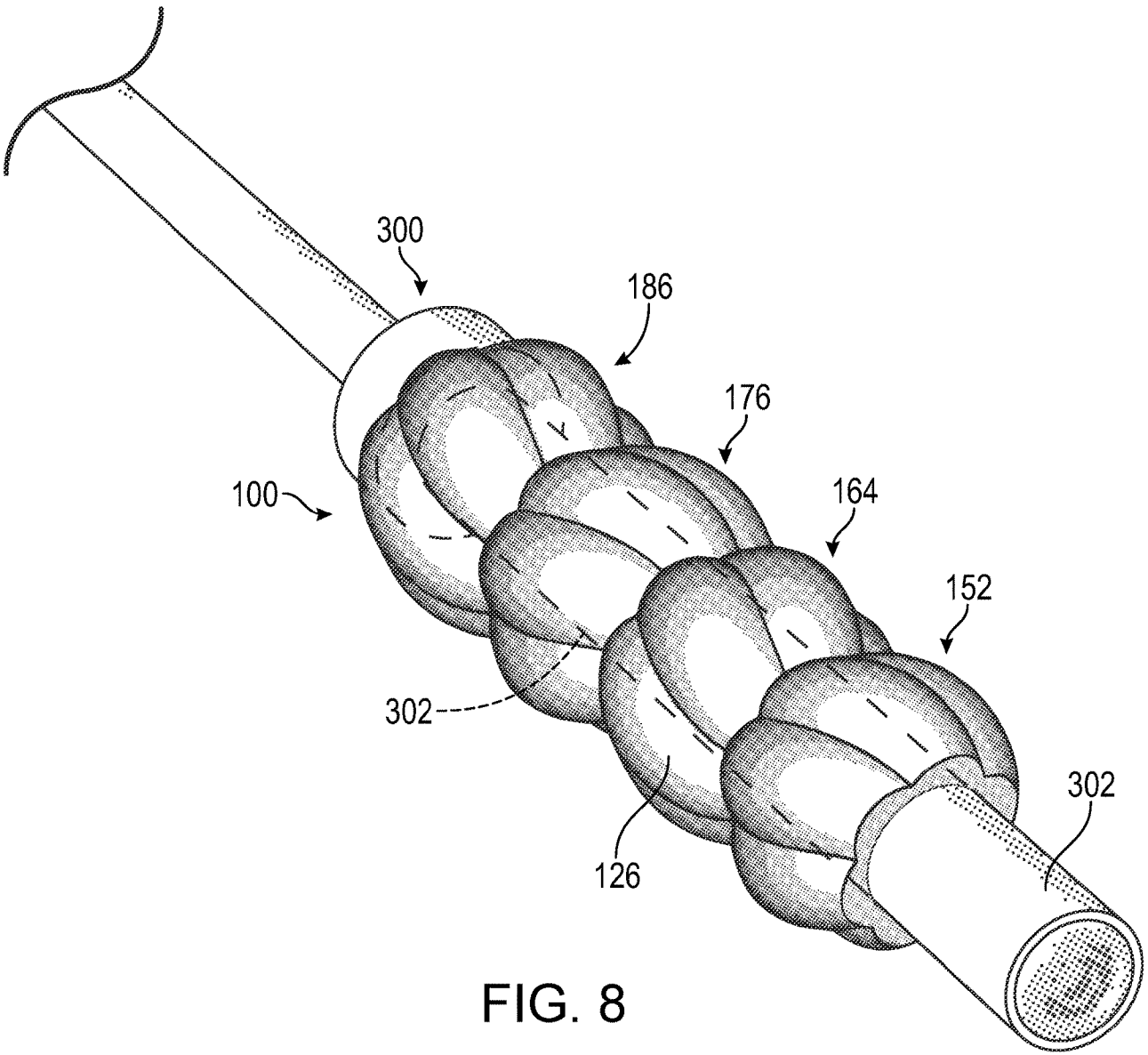
FIG. 8 is a perspective view of the barbell massage roller shown in FIGS. 1-7, further illustrating the barbell massage roller installed onto a sleeve of an exemplary barbell.
Figure 9:
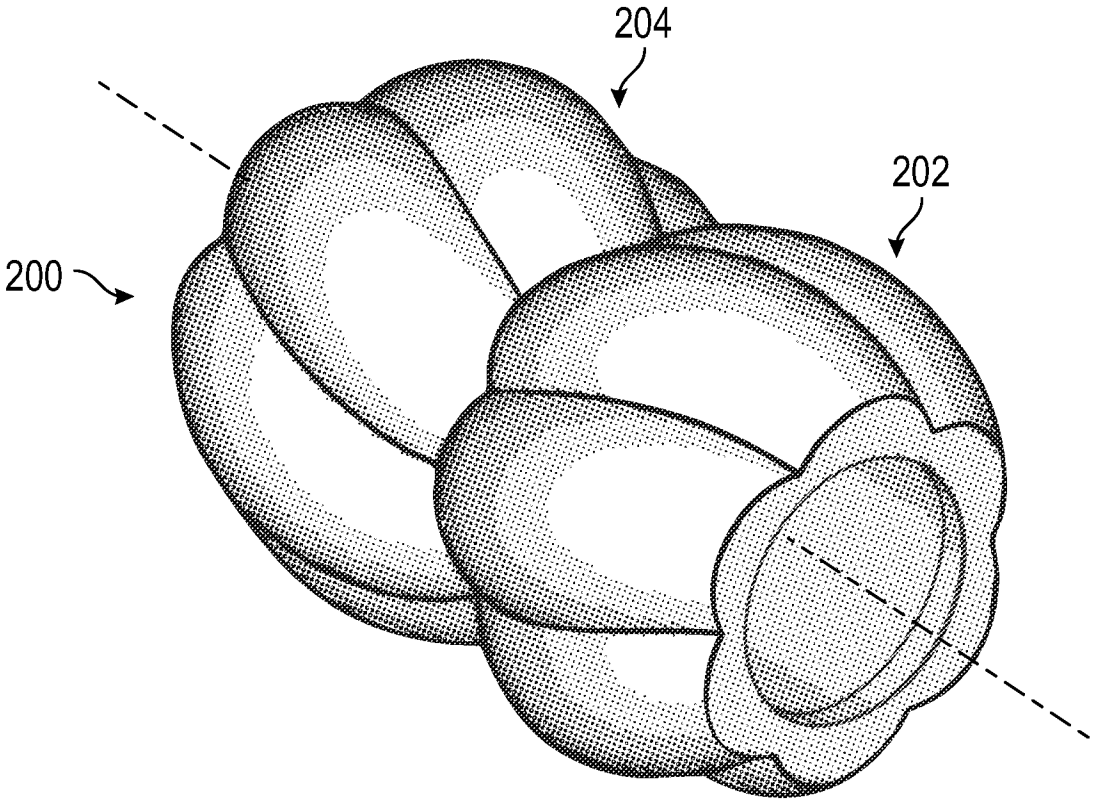
FIG. 9 is a perspective view of a barbell massage roller according to another exemplary embodiment of the present disclosure.
Figure 10:
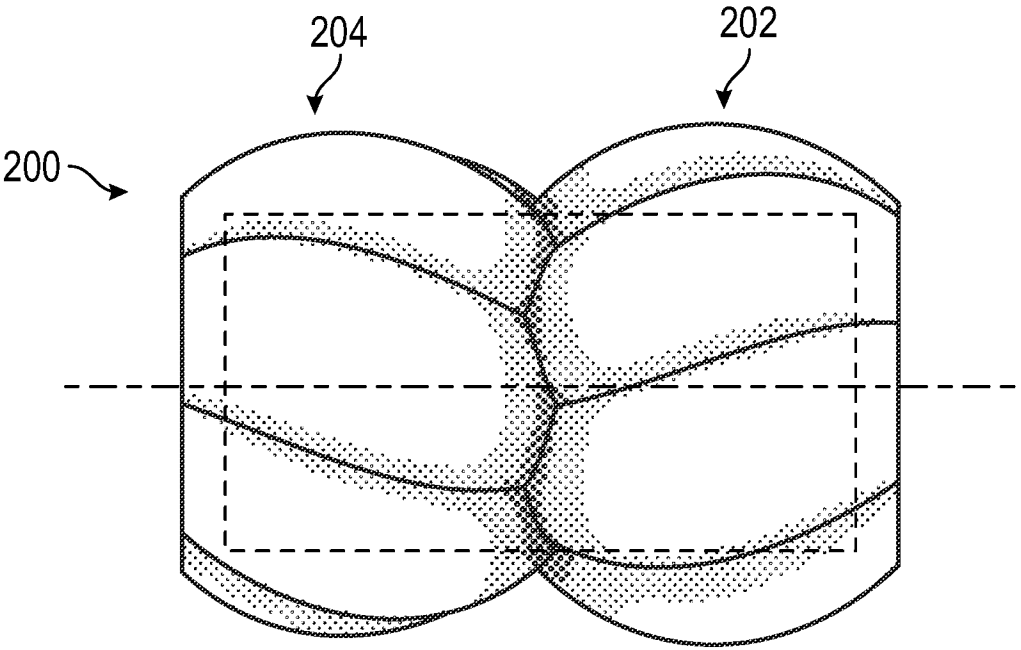
FIG. 10 is a front elevational view of the barbell massage roller shown in FIG. 9.
Figure 11:
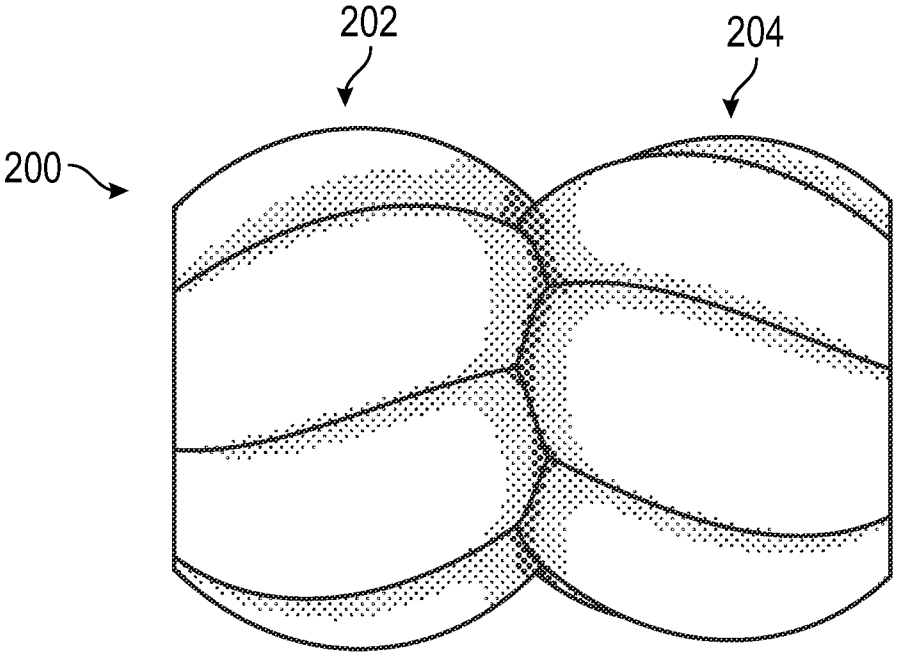
FIG. 11 is a rear elevational view of the barbell massage roller shown in FIGS. 9 and 10.
Figure 12:
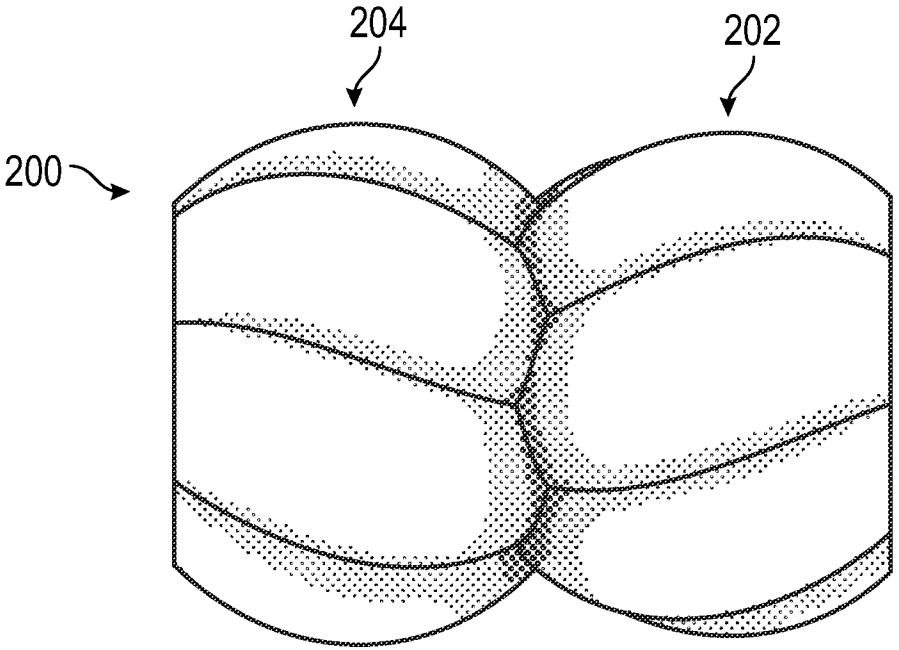
FIG. 12 is a top plan view of the barbell massage roller shown in FIGS. 9-11.
Figure 13:
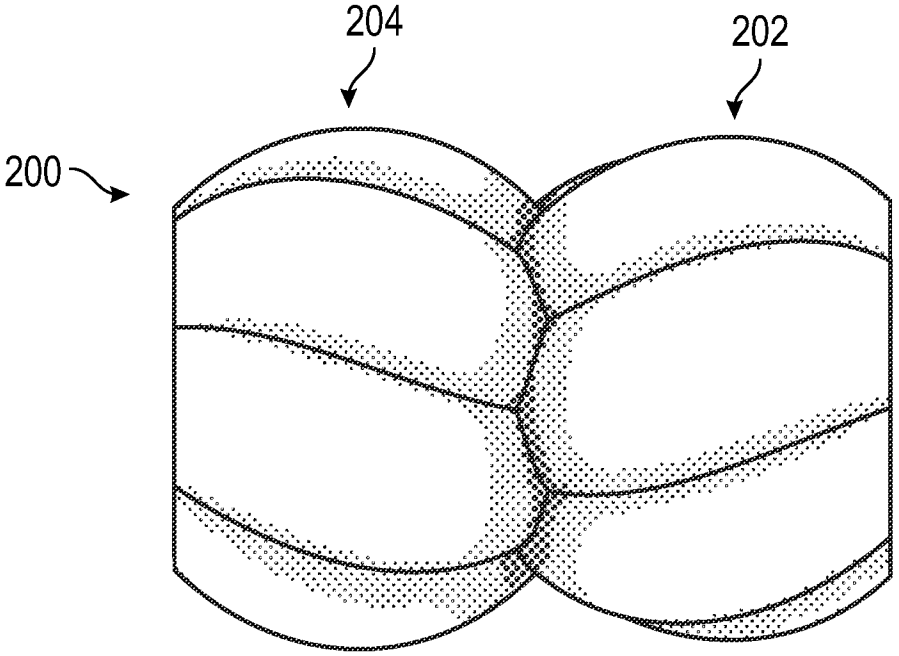
FIG. 13 is a bottom plan view of the barbell massage roller shown in FIGS. 9-12.
Figure 14:
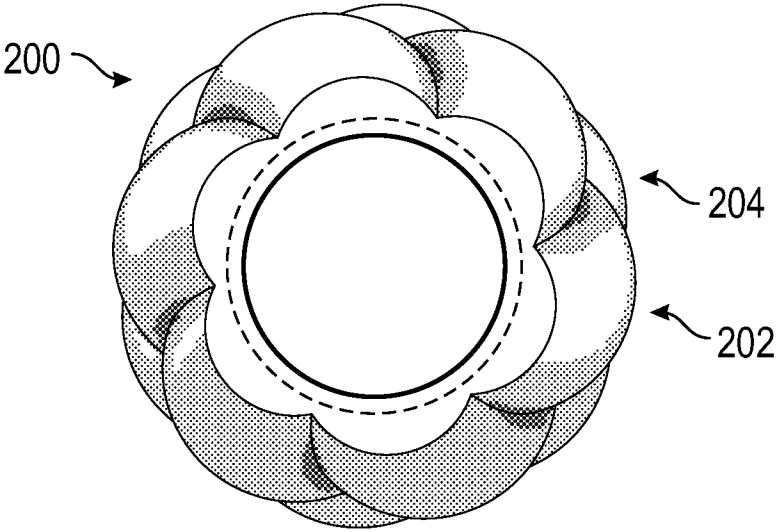
FIG. 14 is a first-end elevational view of the barbell massage roller shown in FIGS. 9-13.
Figure 15:
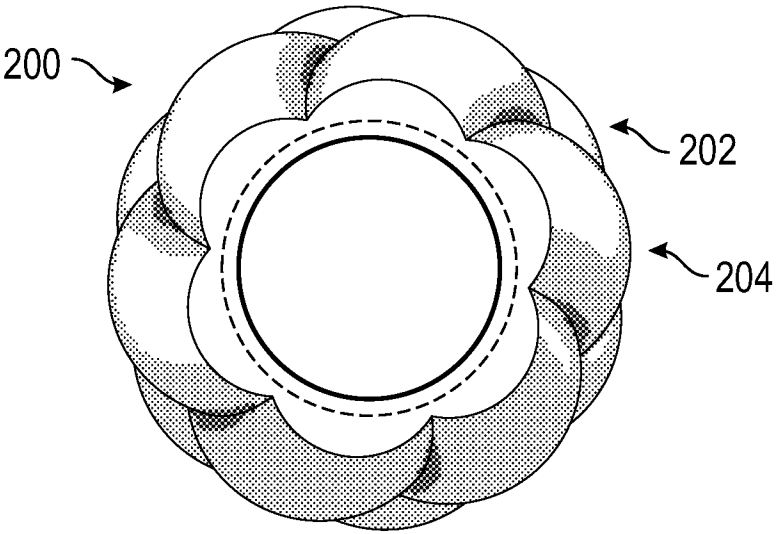
FIG. 15 is a second-end elevational view of the barbell massage roller shown in FIGS. 9-14.
Figure 16:
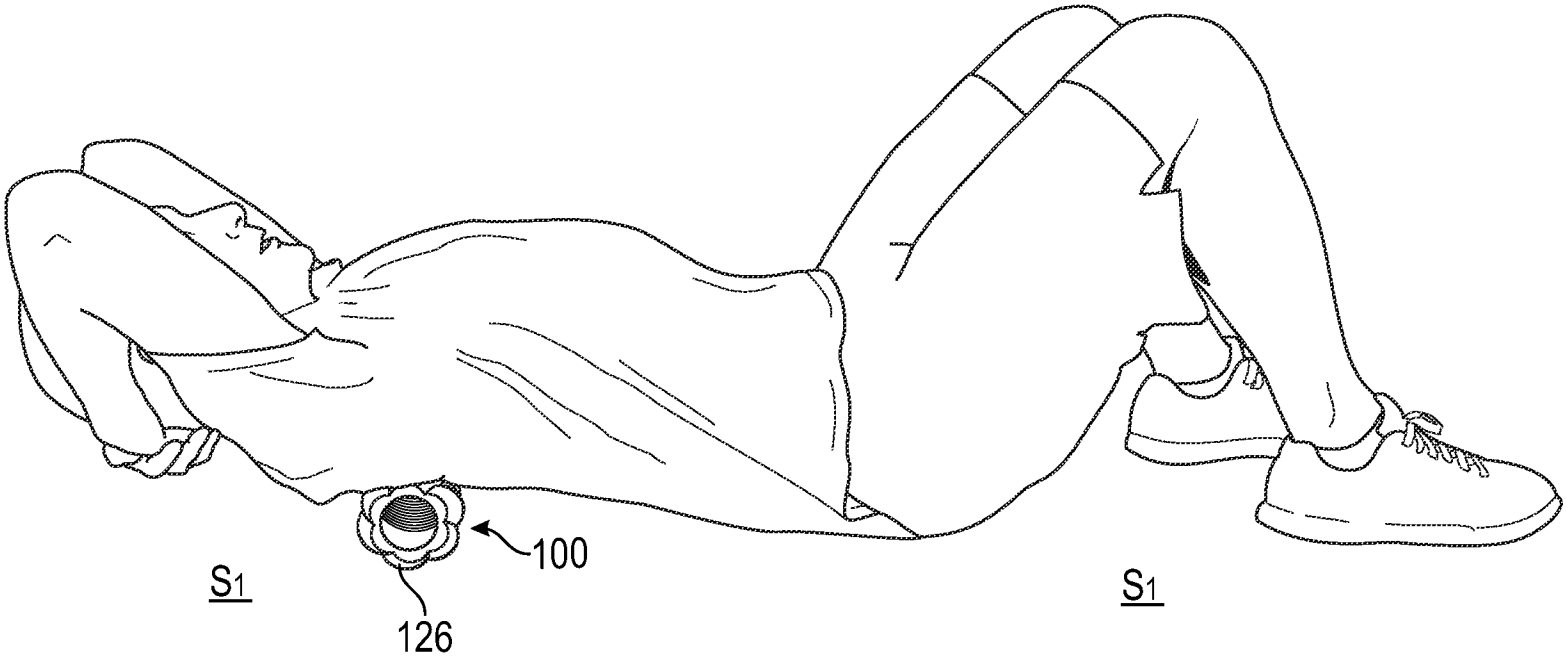
FIGS. 16-19 are various views illustrating some representative self-massage methods that may be performed using either of the barbell massage rollers, respectively shown in FIGS. 1-8 and 9-15, according to the exemplary embodiments of the present disclosure.
Figure 17:
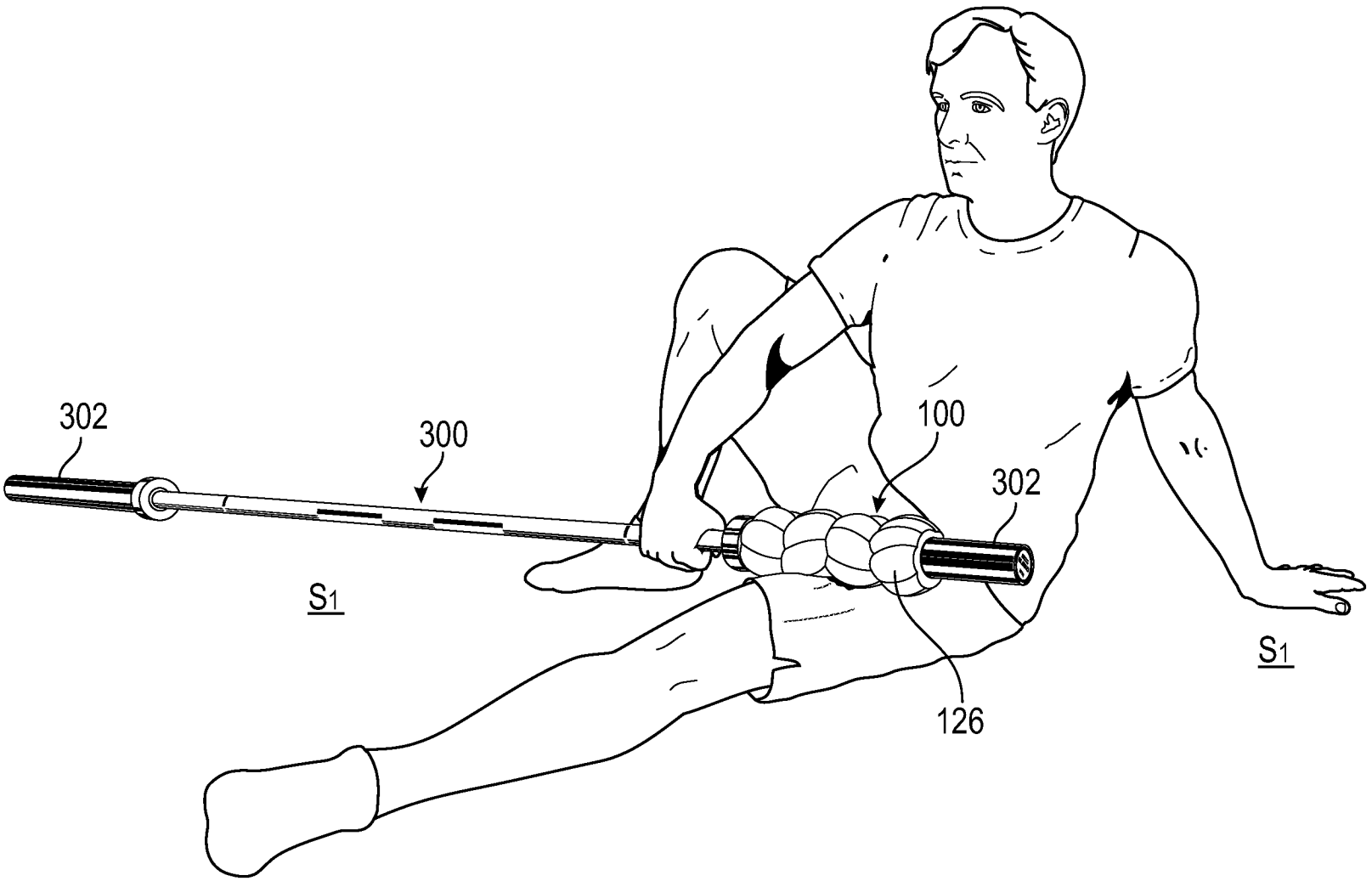
Figure 18:
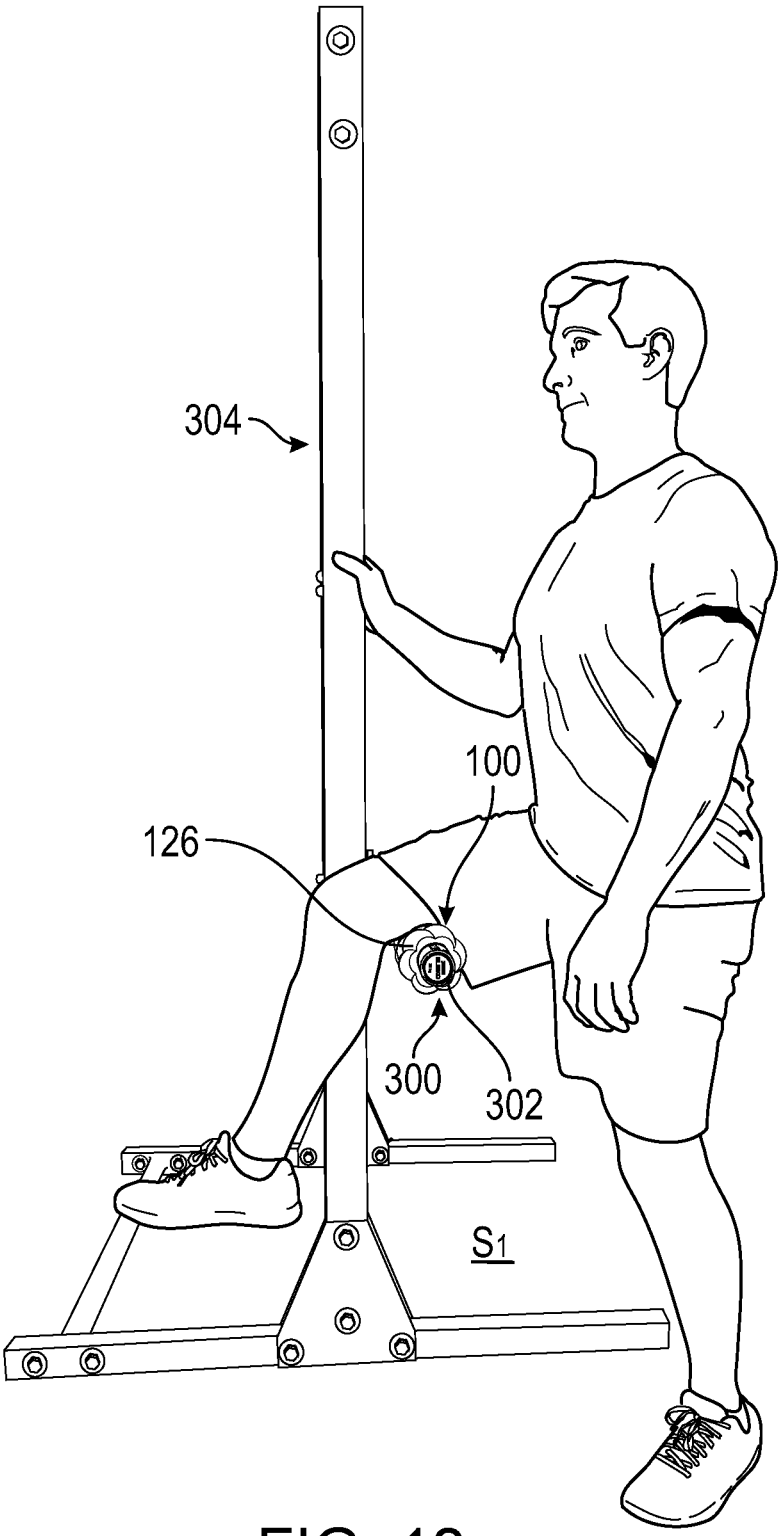
Figure 19:
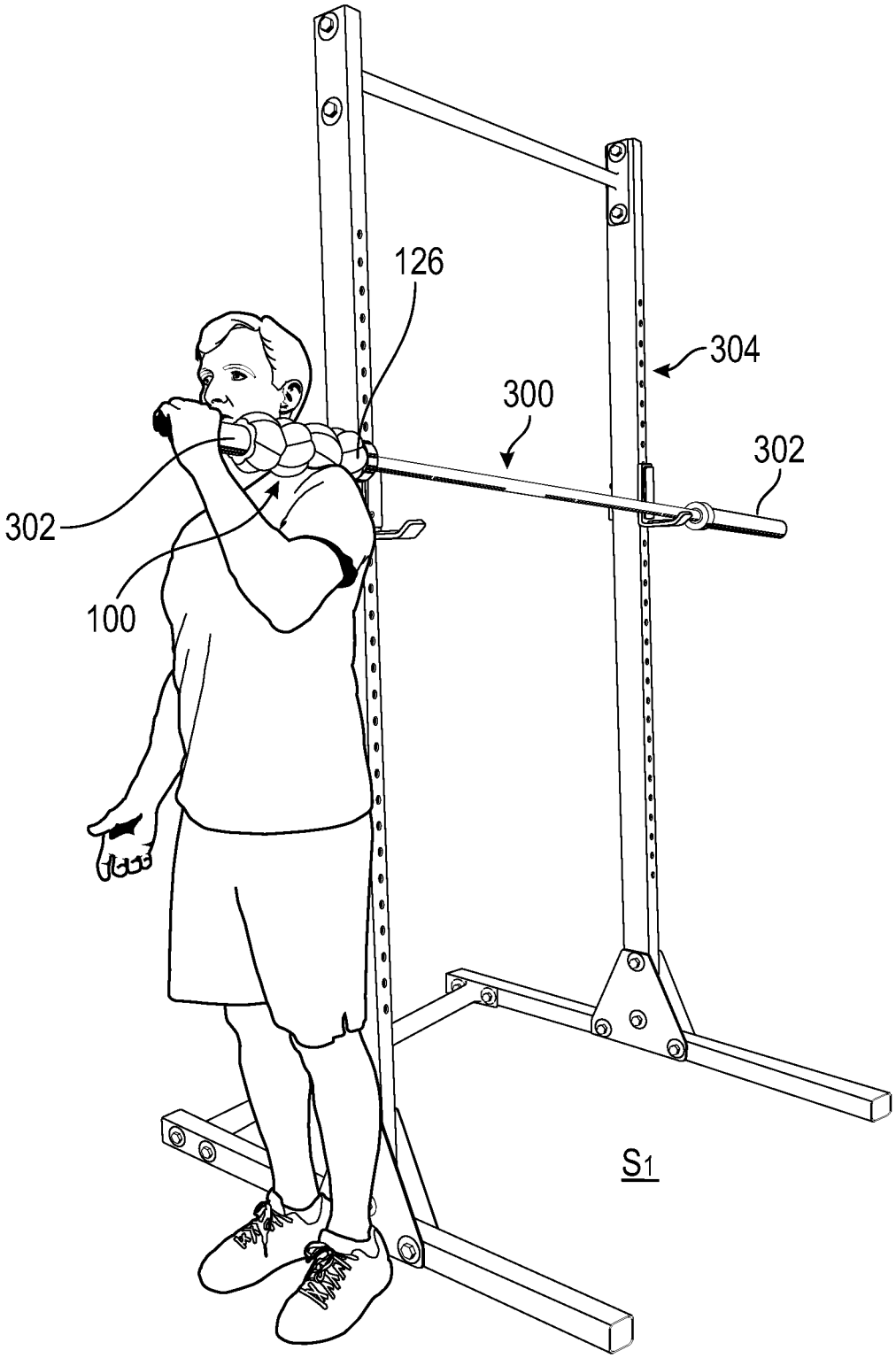

Referring generally to FIGS. 1-19, exemplary barbell massage rollers 100, 200 according to the present disclosure are collectively shown and described. At least one method (e.g., multiple methods) of using a barbell massage roller, such as either of the exemplary barbell massage rollers 100, 200, is also collectively shown and described.

Referring to at least FIGS. 1-8, one exemplary barbell massage roller 100 is shown. The barbell massage roller 100 includes a roller core 102 having a first end 104 and a second end 106 disposed opposite the first end 104. The roller core 102 may be shaped so as to be generally elongated and cylindrical, as will be further described herein. The roller core 102 may have a hollow roller core cavity 108 defined therein, which may advantageously reduce the overall weight of the barbell massage roller 100. The roller core cavity 108 may extend through the entire roller core 102 between the first and second ends 104, 106 of the roller core 102. The roller core cavity 108 defines an interior surface 110 of the roller core 102. The roller core cavity 108 further defines a diameter 112, which is the inner diameter 112 of the roller core 102. The roller core 102 further has an exterior surface 114 opposing the interior surface 110 of the roller core 102. The roller core 102 further has an outer diameter 116. A radial thickness 118 of the roller core 102 is defined between the inner diameter 112 and the outer diameter 116 of the roller core 102. As such, the roller core 102 may be tubular or pipe-like, so as to have an overall length 120 thereof defined between the first and second ends 104, 106 of the roller core 102. As shown throughout at least FIGS. 1-8, a longitudinal center axis 122 of the barbell massage roller 100 may extend through at least the first and second ends 104, 106 of the roller core 102 and through a center 124 of the roller core cavity 108 of the roller core 102.

With further regard to the roller core cavity 108 of the roller core 102, the roller core cavity 108 is preferably shaped and sized (i.e. relating to the inner diameter 112 and overall length 120 of the roller core 102) such that the barbell massage roller 100 is capable of being installed onto a sleeve 302 of a barbell 300, such as a standard Olympic barbell 300 (e.g., as shown in FIGS. 8 and 17-19), thereby permitting a user to administer self-massage when the barbell massage roller 100 is installed onto the sleeve 302 of the standard Olympic barbell 300, as will be further described herein in greater detail.

Regarding construction of the roller core 102, the roller core 102 is preferably rigid such that the roller core 102 resists flexing and/or bending when under a load. As a non-limiting example, the roller core 102 may be comprised of a rigid polymeric material, a metal material or a combination of rigid polymeric and metal materials. As another non-limiting example, the roller core 102 may be comprised of a material selected from the group consisting of plastic, acrylonitrile butadiene styrene, polyurethane, polypropylene, polycarbonate and polyvinyl chloride. The roller core 102 may comprise any other suitable material, as may be understood by one skilled in the art. Furthermore, the roller core 102 may be made by a manufacturing process such as extrusion, bending and welding, or any other suitable manufacturing process, as may be understood by one skilled in the art.

As further shown in at least FIGS. 1-8, the barbell massage roller 100 may further include a roller body 126 having a first end 128 and a second end 130 disposed opposite the first end 128 of the roller body 126. The roller body 126 may be shaped so as to be generally elongated and generally cylindrical, as will be further described herein. The roller body 126 further has a hollow roller body cavity 132 defined therein, as will be further described herein. The roller body 126 further has respective first and second openings 134, 136 defined therein, at the respective first and second ends 128, 130 of the roller body 126, which permit access into the roller body cavity 132. The respective first and second openings 134, 136 may form respective first and second annular ledges 138, 140 disposed at the respective first and second ends 128, 130 of the roller body 126. The respective first and second annular ledges 138, 140 have respective first and second annular ledge diameters 142, 144 which are each preferably equal to or slightly less than the inner diameter 112 of the roller core 102. In either case, the respective first and second annular ledge diameters 142, 144 are each preferably sized such that the barbell massage roller 100 is capable of being installed onto the sleeve 302 of the barbell 300, such as the standard Olympic barbell 300 (e.g., as shown in FIGS. 8 and 17-19), as will be further described herein.

With further regard to the roller body cavity 132, the roller body cavity 132 may extend between the first and second ends 128, 130 of the roller body 126, and more specifically, between the first and second annular ledges 138, 140 disposed at the respective first and second ends 128, 130 of the roller body 126. The roller body cavity 132 may define an interior surface 146 of the roller body 126. The roller body cavity 132 further defines a diameter 148, which is the inner diameter 148 of the roller body 126. As such, the inner diameter 148 of the roller body 126 is preferably sized to correspond to the outer diameter 116 of the roller core 102 such that the roller core 102 may fit within the roller body cavity 132. Additionally, the roller body 126 has an overall length 150 defined between the first and second ends 128, 130 of the roller body 126. The overall length 150 of the roller body 126 is greater than the overall length 120 of the roller core 102, such that the roller core 102 may fit within the roller body cavity 132 between the respective first and second annular ledges 138, 140 disposed at the respective first and second ends 128, 130 of the roller body 126.

Regarding engagement of the roller core 102 with the roller body 126, the roller body 126 may be disposed on the roller core 102 such that the roller core 102 may be disposed at least partially within, and preferably fully within, the roller body cavity 132 of the roller body 126. Furthermore, the roller body 126 may be disposed on the roller core 102 such that the interior surface 146 of the roller body 126 contacts the exterior surface 114 of the roller core 102, and such that the interior surface 146 of the roller body 126 does not slide or rotate with respect to the exterior surface 114 of the roller core 102 (e.g., which may be accomplished by way of friction-fit, shrink-fit, or being glued together with an adhesive substance, etc.).

As shown throughout at least FIGS. 1-8, the roller body 126 further includes a plurality of helical clusters disposed along the longitudinal center axis 122 of the barbell massage roller 100. The plurality of helical clusters includes a first helical cluster 152. The first helical cluster 152 includes a plurality of helical protrusions 154 disposed annularly about the roller body 126. Each of the plurality of helical protrusions 154 are generally elongated and project at least radially outwardly from the roller body 126. Each of the plurality of helical protrusions 154 define at least one curved massage surface area 156. Each of the plurality of helical protrusions 154 are twisted about the longitudinal center axis 122 of the barbell massage roller 100, in a first rotational direction 158, in a helical manner. Each of the plurality of helical protrusions 154 of the first helical cluster 152 have an overall length 160 thereof which is greater than an overall width 162 thereof. The overall length 160 of each of the plurality of helical protrusions 154 of the first helical cluster 152 is greater than the inner diameter 112 of the roller core 102.

The plurality of helical clusters further includes a second helical cluster 164 disposed immediately adjacent to the first helical cluster 152, as will be further described herein. The second helical cluster 164 includes a plurality of helical protrusions 166 disposed annularly about the roller body 126. Each of the plurality of helical protrusions 166 of the second helical cluster 164 are generally elongated and project at least radially outwardly from the roller body 126. Each of the plurality of helical protrusions 166 of the second helical cluster 164 define at least one curved massage surface area 168. Each of the plurality of helical protrusions 166 of the second helical cluster 164 are twisted about the longitudinal center axis 122 of the barbell massage roller 100, in a second rotational direction 170 which is opposite the first rotational direction 158, in a helical manner. Each of the plurality of helical protrusions 166 of the second helical cluster 164 have an overall length 172 thereof which is greater than an overall width 174 thereof. The overall length 172 of each of the plurality of helical protrusions 166 of the second helical cluster 164 is greater than the inner diameter 112 of the roller core 102.

The plurality of helical clusters may further include a third helical cluster 176 disposed immediately adjacent to the second helical cluster 164, as will be further described herein. The third helical cluster 176 includes a plurality of helical protrusions 178 disposed annularly about the roller body 126. Each of the plurality of helical protrusions 178 of the third helical cluster 176 are generally elongated and project at least radially outwardly from the roller body 126. Each of the plurality of helical protrusions 178 of the third helical cluster 176 define at least one curved massage surface area 180. Each of the plurality of helical protrusions 178 of the third helical cluster 176 are twisted about the longitudinal center axis 122 of the barbell massage roller 100, in the first rotational direction 158 which is opposite the second rotational direction 170, in a helical manner. Each of the plurality of helical protrusions 178 of the third helical cluster 176 have an overall length 182 thereof which is greater than an overall width 184 thereof. The overall length 182 of each of the plurality of helical protrusions 178 of the third helical cluster 176 is greater than the inner diameter 112 of the roller core 102.

The plurality of helical clusters may further include a fourth helical cluster 186 disposed immediately adjacent to the third helical cluster 176, as will be further described herein. The fourth helical cluster 186 includes a plurality of helical protrusions 188 disposed annularly about the roller body 126. Each of the plurality of helical protrusions 188 of the fourth helical cluster 186 are generally elongated and project at least radially outwardly from the roller body 126. Each of the plurality of helical protrusions 188 of the fourth helical cluster 186 define at least one curved massage surface area 190. Each of the plurality of helical protrusions 188 of the fourth helical cluster 186 are twisted about the longitudinal center axis 122 of the barbell massage roller 100, in the second rotational direction 170 which is opposite the first rotational direction 158, in a helical manner. Each of the plurality of helical protrusions 188 of the fourth helical cluster 186 have an overall length 192 thereof which is greater than an overall width 194 thereof. The overall length 192 of each of the plurality of helical protrusions 188 of the fourth helical cluster 186 is greater than the inner diameter 112 of the roller core 102.

As further shown throughout at least FIGS. 1-8, consecutive helical protrusions 154 of the plurality of helical protrusions 154 of the first helical cluster 152 are disposed immediately adjacent to each other such that the consecutive helical protrusions 154 of the plurality of helical protrusions 154 of the first helical cluster 152 are spaced apart from each other by a first distance D1.

Furthermore, consecutive helical protrusions 166 of the plurality of helical protrusions 166 of the second helical cluster 164 are disposed immediately adjacent to each other such that the consecutive helical protrusions 166 of the plurality of helical protrusions 166 of the second helical cluster 164 are spaced apart from each other by a second distance D2.

Furthermore, consecutive helical protrusions 178 of the plurality of helical protrusions 178 of the third helical cluster 176 are disposed immediately adjacent to each other such that the consecutive helical protrusions 178 of the plurality of helical protrusions 178 of the third helical cluster 176 are spaced apart from each other by a third distance D3.

Furthermore, consecutive helical protrusions 188 of the plurality of helical protrusions 188 of the fourth helical cluster 186 are disposed immediately adjacent to each other such that the consecutive helical protrusions 188 of the plurality of helical protrusions 188 of the fourth helical cluster 186 are spaced apart from each other by a fourth distance D4.

As further shown throughout at least FIGS. 1-8, the second helical cluster 164 is disposed immediately adjacent to the first helical cluster 152 such that the second helical cluster 164 is spaced apart from the first helical cluster 152 by a fifth distance D5. The fifth distance D5 is substantially less than the overall width 162, 174, 184, 194 of each of the plurality of helical protrusions 154, 166, 178, 188 of the first, second, third and fourth helical clusters 152, 164, 176, 186.

Furthermore, the third helical cluster 176 is disposed immediately adjacent to the second helical cluster 164 such that the third helical cluster 176 is spaced apart from the second helical cluster 164 by a sixth distance D6. The sixth distance D6 is substantially less than the overall width 162, 174, 184, 194 of each of the plurality of helical protrusions 154, 166, 178, 188 of the first, second, third and fourth helical clusters 152, 164, 176, 186.

Furthermore, the fourth helical cluster 186 is disposed immediately adjacent to the third helical cluster 176 such that the fourth helical cluster 186 is spaced apart from the third helical cluster 176 by a seventh distance D7. The seventh distance D7 is substantially less than the overall width 162, 174, 184, 194 of each of the plurality of helical protrusions 154, 166, 178, 188 of the first, second, third and fourth helical clusters 152, 164, 176, 186. Furthermore, the first, second, third, fourth, fifth, sixth and seventh distances D1, D2, D3, D4, D5, D6, D7, as described above relating to the first, second, third and fourth helical clusters 152, 164, 176, 186, are substantially equal to each other.

As further shown throughout at least FIGS. 1-8, the first, second, third and fourth helical clusters 152, 164, 176, 186 are generally spheroidal such that they are generally shaped like a sphere but are not entirely spherical. As such, the generally spheroidal first, second, third and fourth helical clusters 152, 164, 176, 186 enable the roller body 126 to be capable of rolling smoothly about the longitudinal center axis 122 of the barbell massage roller 100 when the roller body 126 is in contact with a flat surface. Furthermore, the overall structure, shape and proportions of the first, second, third and fourth helical clusters 152, 164, 176, 186, as shown and described herein, are particularly effective in accessing hard to reach contours of the human body during massage. As described, the overall shape and configuration of the roller body 126 allows the user to practice directed massage methods, such as deep tissue massage, as well as directional massage methods, such as the Effleurage massage method. Furthermore, the curved massage surface areas 156, 168, 180, 190 of the respective first, second, third and fourth helical clusters 152, 164, 176, 186 also allow the user to address specific trigger points in the human body during massage.

While first, second, third and fourth helical clusters 152, 164, 176, 186 are shown and described herein, it is to be understood that the roller body 126 may include any number of suitable helical clusters, such as one, two (as shown in FIGS. 9-15), three, or more than four.

Regarding construction of the roller body 126, the roller body 126 is preferably resilient, yet firm enough to deliver deep tissue massage on a user, but not too firm so as to be capable of harming the user during massage. As a non-limiting example, the roller body 126 may be comprised of an elastomeric polymer. As another non-limiting example, the roller body 126 may be comprised of a material selected from the group consisting of foam, ethylene-vinyl acetate, polyurethane, polyethylene, polystyrene, polypropylene, rubber, silicone and neoprene. The roller body 126 may comprise any other suitable material, as may be understood by one skilled in the art. Furthermore, the roller body 126 may be made by a manufacturing process such as injection molding, or any other suitable manufacturing process, as may be understood by one skilled in the art.

Referring to FIGS. 9-15, a barbell massage roller 200 according to another exemplary embodiment of the present disclosure is shown. In this example, the barbell massage roller 200 is substantially identical to the barbell massage roller 100, as described herein, with the exception of the barbell massage roller 200 including a first helical cluster 202 and a second helical cluster 204 (thus not including the two innermost helical clusters which the barbell massage roller 100 includes). As such, for simplicity, further details of the barbell massage roller 200 will not be further described.

Referring to FIGS. 16-19, various views illustrate some representative self-massage methods that may be performed using either of the barbell massage rollers 100, 200, respectively shown in FIGS. 1-8 and 9-15, according to the exemplary embodiments of the present disclosure. A method of using barbell massage roller includes providing a barbell massage roller, such as barbell massage roller 100, such as shown and described herein, placing the barbell massage roller 100 between a user's body and a fixed support surface Si, and applying and rolling the roller body 126 of the barbell massage roller 100 against a surface of the user's body and against the fixed support surface Si so as to administer self-massage. The method may also include providing a standard Olympic barbell 300, inserting a sleeve 302 of the standard Olympic barbell 300 into the roller core cavity 108 of the roller core 102 of the barbell massage roller 100 so as to install the barbell massage roller 100 onto the sleeve 302 of the standard Olympic barbell 300, grasping and holding the standard Olympic barbell 300 and/or placing the standard Olympic barbell 300 onto a stationary support, such as a barbell rack 304, and applying and rolling the roller body 126 of the barbell massage roller 100 against a surface of a user's body so as to administer self-massage.

While one or more exemplary embodiments are described above, it is not intended that these embodiments describe all possible forms of the disclosure. Rather, the words used in the specification are words of description rather than limitation, and it is understood that various changes may be made without departing from the spirit and scope of the disclosure.

With regard to any processes, systems, methods, heuristics, etc., described herein, it should be understood that, although the steps of such processes, etc., have been described as occurring according to a certain ordered sequence, such processes could be practiced with the described steps performed in an order other than the order described herein. It should be further understood that certain steps could be performed simultaneously, that other steps could be added, or that certain steps described herein could be omitted. In other words, the descriptions of processes described above are provided for the purpose of illustrating certain embodiments, and should in no way be construed so as to limit the claims.

As used in this specification and claims, the terms "for example"/("e.g."), "for instance", "such as", and "like", and the verbs "comprising", "having", "including", and their other verb forms, when used in conjunction with a listing of one or more carriers or other items, are each to be construed as open-ended, meaning that the listing is not to be considered as excluding other, additional carriers or items. Other terms are to be construed using their broadest reasonable meaning unless they are used in a context that requires a different interpretation.

What is claimed is:

1. A barbell massage roller, comprising:

a generally elongated, cylindrical roller core having a first end and a second end disposed opposite the first end, the roller core further having a hollow roller core cavity defined therein and extending through the roller core between the first and second ends of the roller core, the roller core cavity defining an interior surface of the roller core, the roller core further having an exterior surface opposing the interior surface of the roller core, wherein a longitudinal center axis of the barbell massage roller extends through at least the first and second ends of the roller core and through a center of the roller core cavity of the roller core; and a generally elongated roller body having a first end and a second end disposed opposite the first end of the roller body, the roller body further having a hollow roller body cavity defined therein and extending between the first and second ends of the roller body, the roller body cavity defining an interior surface of the roller body, the roller body being disposed on the roller core such that the roller core is disposed at least partially within the roller body cavity of the roller body, the roller body further including a plurality of helical clusters disposed along the longitudinal center axis of the barbell massage roller, the plurality of helical clusters including:

a first helical cluster including a plurality of helical protrusions disposed annularly about the roller body, each of the plurality of helical protrusions being generally elongated and projecting at least radially outwardly from the roller body, each of the plurality of helical protrusions defining at least one curved massage surface area, each of the plurality of helical protrusions further being twisted about the longitudinal center axis of the barbell massage roller, in a first rotational direction, in a helical manner, and a second helical cluster disposed immediately adjacent to the first helical cluster, the second helical cluster including a plurality of helical protrusions disposed annularly about the roller body, each of the plurality of helical protrusions of the second helical cluster being generally elongated and projecting at least radially outwardly from the roller body, each of the plurality of helical protrusions of the second helical cluster defining at least one curved massage surface area, each of the plurality of helical protrusions of the second helical cluster further being twisted about the longitudinal center axis of the barbell massage roller, in a second rotational direction which is opposite the first rotational direction, in a helical manner; and wherein at least the roller core cavity of the roller core is shaped and sized such that the barbell massage roller is capable of being installed onto a sleeve of a barbell, thereby permitting a user to administer self-massage when the barbell massage roller is installed onto the sleeve of the barbell.

2. The barbell massage roller according to claim 1, wherein the plurality of helical clusters of the roller body further includes:

a third helical cluster disposed immediately adjacent to the second helical cluster, the third helical cluster including a plurality of helical protrusions disposed annularly about the roller body, each of the plurality of helical protrusions of the third helical cluster being generally elongated and projecting at least radially outwardly from the roller body, each of the plurality of helical protrusions of the third helical cluster defining at least one curved massage surface area, each of the plurality of helical protrusions of the third helical cluster further being twisted about the longitudinal center axis of the barbell massage roller, in the first rotational direction which is opposite the second rotational direction, in a helical manner.

3. The barbell massage roller according to claim 2, wherein the plurality of helical clusters of the roller body further includes:

a fourth helical cluster disposed immediately adjacent to the third helical cluster, the fourth helical cluster including a plurality of helical protrusions disposed annularly about the roller body, each of the plurality of helical protrusions of the fourth helical cluster being generally elongated and projecting at least radially outwardly from the roller body, each of the plurality of helical protrusions of the fourth helical cluster defining at least one curved massage surface area, each of the plurality of helical protrusions of the fourth helical cluster further being twisted about the longitudinal center axis of the barbell massage roller, in the second rotational direction which is opposite the first rotational direction, in a helical manner.

4. The barbell massage roller according to claim 3, wherein each of the plurality of helical protrusions of the first, second, third and fourth helical clusters have an overall length thereof which is greater than an overall width thereof, and wherein the overall length of each of the plurality of helical protrusions of the first, second, third and fourth helical clusters is greater than an inner diameter of the roller core.

5. The barbell massage roller according to claim 3, wherein consecutive helical protrusions of the plurality of helical protrusions of the first helical cluster are disposed immediately adjacent to each other such that the consecutive helical protrusions of the plurality of helical protrusions of the first helical cluster are spaced apart from each other by a first distance, wherein consecutive helical protrusions of the plurality of helical protrusions of the second helical cluster are disposed immediately adjacent to each other such that the consecutive helical protrusions of the plurality of helical protrusions of the second helical cluster are spaced apart from each other by a second distance, wherein consecutive helical protrusions of the plurality of helical protrusions of the third helical cluster are disposed immediately adjacent to each other such that the consecutive helical protrusions of the plurality of helical protrusions of the third helical cluster are spaced apart from each other by a third distance, wherein consecutive helical protrusions of the plurality of helical protrusions of the fourth helical cluster are disposed immediately adjacent to each other such that the consecutive helical protrusions of the plurality of helical protrusions of the fourth helical cluster are spaced apart from each other by a fourth distance, wherein the second helical cluster is disposed immediately adjacent to the first helical cluster such that the second helical cluster is spaced apart from the first helical cluster by a fifth distance, wherein the third helical cluster is disposed immediately adjacent to the second helical cluster such that the third helical cluster is spaced apart from the second helical cluster by a sixth distance, wherein the fourth helical cluster is disposed immediately adjacent to the third helical cluster such that the fourth helical cluster is spaced apart from the third helical cluster by a seventh distance, and wherein the first, second, third, fourth, fifth, sixth and seventh distances are substantially equal.

6. The barbell massage roller according to claim 3, wherein each of the plurality of helical protrusions of the first, second, third and fourth helical clusters have an overall length thereof which is greater than an overall width thereof, wherein the second helical cluster is disposed immediately adjacent to the first helical cluster such that the second helical cluster is spaced apart from the first helical cluster by a distance which is substantially less than the overall width of each of the plurality of helical protrusions of the first, second, third and fourth helical clusters, wherein the third helical cluster is disposed immediately adjacent to the second helical cluster such that the third helical cluster is spaced apart from the second helical cluster by a distance which is substantially less than the overall width of each of the plurality of helical protrusions of the first, second, third and fourth helical clusters, and wherein the fourth helical cluster is disposed immediately adjacent to the third helical cluster such that the fourth helical cluster is spaced apart from the third helical cluster by a distance which is substantially less than the overall width of each of the plurality of helical protrusions of the first, second, third and fourth helical clusters.

7. The barbell massage roller according to claim 1, wherein each of the plurality of helical protrusions of the first and second helical clusters have an overall length thereof which is greater than an overall width thereof, and wherein the overall length of each of the plurality of helical protrusions of the first and second helical clusters is greater than an inner diameter of the roller core.

8. The barbell massage roller according to claim 1, wherein consecutive helical protrusions of the plurality of helical protrusions of the first helical cluster are disposed immediately adjacent to each other such that the consecutive helical protrusions of the plurality of helical protrusions of the first helical cluster are spaced apart from each other by a first distance, wherein consecutive helical protrusions of the plurality of helical protrusions of the second helical cluster are disposed immediately adjacent to each other such that the consecutive helical protrusions of the plurality of helical protrusions of the second helical cluster are spaced apart from each other by a second distance, wherein the second helical cluster is disposed immediately adjacent to the first helical cluster such that the second helical cluster is spaced apart from the first helical cluster by a third distance, and wherein the first, second and third distances are substantially equal.

9. The barbell massage roller according to claim 1, wherein each of the plurality of helical protrusions of the first and second helical clusters have an overall length thereof which is greater than an overall width thereof, and wherein the second helical cluster is disposed immediately adjacent to the first helical cluster such that the second helical cluster is spaced apart from the first helical cluster by a distance which is substantially less than the overall width of each of the plurality of helical protrusions of the first and second helical clusters.

10. The barbell massage roller according to claim 1, wherein at least the roller core cavity of the roller core is shaped and sized such that the barbell massage roller is capable of being installed onto a sleeve of a standard Olympic barbell, thereby permitting a user to administer self-massage when the barbell massage roller is installed onto the sleeve of the standard Olympic barbell.

11. The barbell massage roller according to claim 1, wherein the roller body is disposed on the roller core such that the interior surface of the roller body does not slide or rotate with respect to the exterior surface of the roller core.

12. The barbell massage roller according to claim 1, wherein the roller core has an overall length defined between the first and second ends of the roller core, the roller body has an overall length defined between the first and second ends of the roller body, and wherein the overall length of the roller body is greater than the overall length of the roller core.

13. The barbell massage roller according to claim 1, wherein the roller core is comprised of a rigid polymeric material, a metal material or a combination of rigid polymeric and metal materials.

14. The barbell massage roller according to claim 1, wherein the roller core is comprised of a material selected from the group consisting of plastic, acrylonitrile butadiene styrene, polyurethane, polypropylene, polycarbonate and polyvinyl chloride.

15. The barbell massage roller according to claim 1, wherein the roller body is comprised of an elastomeric polymer.

16. The barbell massage roller according to claim 1, wherein the roller body is comprised of a material selected from the group consisting of foam, ethylene-vinyl acetate, polyurethane, polyethylene, polystyrene, polypropylene, rubber, silicone and neoprene.

17. A barbell massage roller, comprising:

a generally elongated, cylindrical, rigid roller core having a first end and a second end disposed opposite the first end, the roller core further having a hollow roller core cavity defined therein and extending through the roller core between the first and second ends of the roller core, the roller core cavity defining an interior surface of the roller core, the roller core further having an exterior surface opposing the interior surface of the roller core, wherein a longitudinal center axis of the barbell massage roller extends through at least the first and second ends of the roller core and through a center of the roller core cavity of the roller core; and a generally elongated, resilient roller body having a first end and a second end disposed opposite the first end of the roller body, the roller body further having a hollow roller body cavity defined therein and extending between the first and second ends of the roller body, the roller body cavity defining an interior surface of the roller body, the roller body being disposed on the roller core such that the roller core is disposed at least partially within the roller body cavity of the roller body, the roller body further including a plurality of helical clusters disposed along the longitudinal center axis of the barbell massage roller, the plurality of helical clusters including:

a first helical cluster including a plurality of helical protrusions disposed annularly about the roller body, each of the plurality of helical protrusions being generally elongated and projecting at least radially outwardly from the roller body, each of the plurality of helical protrusions defining at least one curved massage surface area, each of the plurality of helical protrusions further being twisted about the longitudinal center axis of the barbell massage roller, in a first rotational direction, in a helical manner, a second helical cluster disposed immediately adjacent to the first helical cluster, the second helical cluster including a plurality of helical protrusions disposed annularly about the roller body, each of the plurality of helical protrusions of the second helical cluster being generally elongated and projecting at least radially outwardly from the roller body, each of the plurality of helical protrusions of the second helical cluster defining at least one curved massage surface area, each of the plurality of helical protrusions of the second helical cluster further being twisted about the longitudinal center axis of the barbell massage roller, in a second rotational direction which is opposite the first rotational direction, in a helical manner, a third helical cluster disposed immediately adjacent to the second helical cluster, the third helical cluster including a plurality of helical protrusions disposed annularly about the roller body, each of the plurality of helical protrusions of the third helical cluster being generally elongated and projecting at least radially outwardly from the roller body, each of the plurality of helical protrusions of the third helical cluster defining at least one curved massage surface area, each of the plurality of helical protrusions of the third helical cluster further being twisted about the longitudinal center axis of the barbell massage roller, in the first rotational direction which is opposite the second rotational direction, in a helical manner, and a fourth helical cluster disposed immediately adjacent to the third helical cluster, the fourth helical cluster including a plurality of helical protrusions disposed annularly about the roller body, each of the plurality of helical protrusions of the fourth helical cluster being generally elongated and projecting at least radially outwardly from the roller body, each of the plurality of helical protrusions of the fourth helical cluster defining at least one curved massage surface area, each of the plurality of helical protrusions of the fourth helical cluster further being twisted about the longitudinal center axis of the barbell massage roller, in the second rotational direction which is opposite the first rotational direction, in a helical manner; and wherein at least the roller core cavity of the roller core is shaped and sized such that the barbell massage roller is capable of being installed onto a sleeve of a standard Olympic barbell, thereby permitting a user to administer self-massage when the barbell massage roller is installed onto the sleeve of the standard Olympic barbell.

* * * * *